US008015776B2

(12) United States Patent
Alfonso et al.

(10) Patent No.: US 8,015,776 B2
(45) Date of Patent: Sep. 13, 2011

(54) OVERHEAD LUG SYSTEM FOR PACKAGING MACHINE

(75) Inventors: Vicenc Alfonso Alfonso, Catalonia (ES); Vicente Marquez Estevez, Catalonia (ES)

(73) Assignee: Graphic Packaging International, Inc., Marietta, GA (US)

( * ) Notice: Subject to any disclaimer, the term of this patent is extended or adjusted under 35 U.S.C. 154(b) by 960 days.

(21) Appl. No.: 11/692,515

(22) Filed: Mar. 28, 2007

(65) Prior Publication Data

US 2007/0240381 A1 Oct. 18, 2007

(30) Foreign Application Priority Data

Apr. 12, 2006 (ES) ..... 200600956

(51) Int. Cl.
*B65B 5/08* (2006.01)

(52) U.S. Cl. ..... 53/251; 53/257; 53/473; 53/534; 198/725

(58) Field of Classification Search ..... 53/247, 53/250, 251, 253, 257, 534, 473; 198/725, 198/728, 732
See application file for complete search history.

(56) References Cited

U.S. PATENT DOCUMENTS

| | | | | |
|---|---|---|---|---|
| 3,194,382 | A * | 7/1965 | Nigrelli et. al. | 198/418.1 |
| 4,531,345 | A * | 7/1985 | Nigrelli et al. | 53/534 |
| 4,642,967 | A * | 2/1987 | Culpepper | 53/398 |
| 5,056,298 | A * | 10/1991 | Deadmond | 53/534 |
| 5,501,318 | A * | 3/1996 | Disrud | 198/732 |
| 5,711,137 | A | 1/1998 | Moncrief et al. | |
| 5,761,882 | A * | 6/1998 | Gambetti | 53/445 |
| 5,775,067 | A | 7/1998 | Hawley | |
| 5,809,746 | A * | 9/1998 | DePuy | 53/458 |
| 6,279,301 | B1 * | 8/2001 | Corniani et al. | 53/458 |

FOREIGN PATENT DOCUMENTS

| | | |
|---|---|---|
| EP | 0 994 026 A1 | 4/2000 |
| WO | WO 97/26188 | 7/1997 |

* cited by examiner

*Primary Examiner* — Thanh Truong
(74) *Attorney, Agent, or Firm* — Womble Carlyle Sandridge & Rice, PLLC

(57) ABSTRACT

A product packaging system is provided having a series of selector wedges that engage the lower portions of a series of products moving along a product infeed conveyor. The selector wedges separate the products into product groups for loading into product cartons moving adjacent the product infeed conveyor. At approximately the same time the selector wedges are engaging the products, a series of lugs are conveyed by an overhead lug system into engagement with each of the products being engaged so as to help stabilize the products and prevent tipping of the products as they are separated and loaded into their corresponding product cartons.

13 Claims, 6 Drawing Sheets

OVERHEAD LUG SYSTEM FOR PACKAGING MACHINE

CROSS-REFERENCE TO RELATED APPLICATION

This application claims the benefit of Spanish Application No. 200600956/7, filed Apr. 12, 2006, which is incorporated by reference herein it its entirety.

FIELD OF THE INVENTION

The present invention generally relates to the packaging of products within product cartons, and in particular to an overhead lug system for engaging and helping to stabilize taller products as the products are separated and fed into their product cartons by a series of selector wedges.

BACKGROUND OF THE INVENTION

In the packaging of products such as bottles, cans, and other relatively tall products, the products generally are fed in a substantially upright attitude along a product infeed conveyor, to a point at which they are separated into lines or product lanes and guided toward a series of cartons moving along an adjacent carton conveyor. The products typically will be engaged along their lower or bottom portions by a series of selector wedges that separate the lines of products into product groups of two to four products for introduction into a corresponding product carton. The selector wedges are moved along a path beneath the product lanes or guides and therefore typically have a low profile so as to enable the selector wedges to pass under the lane guides. Because the selector wedges generally contact only the bottom portion of the last product in the group being selected along a particular lane, each product being engaged tends to have a natural tendency to tumble or fall backwards as it is accelerated by the selector wedge as the selector wedge separates the group of products from the remaining products in the lane. The taller the product being selected, the greater tendency the product will have to fall backwards due to the acceleration thereof by the selector wedge.

Historically, the principal solution to the problem of products tumbling and falling backwards over the selector wedges has been to increase the height of the selector wedges to increase the area of contact between the selector wedges and the bottom portions of the products being engaged. With the selector wedges engaging more of the product, the stability of the product is accordingly increased. However, increasing the height of the selector wedges has tended to create other problems. For example, for products such as bottles having labels applied thereto, the labels can be damaged or marred by the selector wedges engaging and rubbing therealong.

In addition, the height of push-in wheels or similar downstream loading devices positioned adjacent the end of the packaging line to complete the loading of the products within the cartons generally must be raised to allow the taller selector wedges to run thereunder. However, raising the push-in wheel height position tends to cause the products engaged by the push-in wheel to be contracted and pushed above their center of gravity, which can cause the products to tip forwardly or otherwise become unstable during loading into the cartons. Further, for contoured or specially-shaped products, such as bottles with concave profiles, increasing the height of the selector wedges often is ineffective at providing additional stability due to the inward curvature of the bottle providing only a small contact area with the selector wedge, thus enabling the bottle to still tumble and fall backwards as it is accelerated.

Accordingly, it can be seen that a need exists for a product packaging system that addresses the foregoing and other related and unrelated problems in the art.

SUMMARY OF THE INVENTION

Briefly described, the present invention generally relates to packaging systems and equipment for packaging relatively taller articles such as bottles, cans, and other, similar articles or products, moving along a packaging line in a upstanding substantially, vertically oriented attitude, within a series of product cartons. The packaging system of the present invention generally will include a product infeed conveyor generally positioned adjacent and extending substantially parallel to a carton conveyor. A series of products, such as bottles or cans, are conveyed along the upper surface of the product infeed conveyor along a path of travel that initially is substantially parallel to the path of travel of the cartons along the carton conveyor.

The products are fed into engagement with a series of lane guides defining product lanes therebetween, and along which separate lines of products are directed toward the cartons. The lane guides each generally comprise an elongated plate or partition having an upstream or first portion that generally extends along the path of travel of the products, and a second or downstream section that typically extends at an angle with respect to the path of travel of the products along the product infeed conveyor, toward the carton conveyor. The products are received and separated into their product lanes, with the products being directed along the lanes toward a loading position for loading into the product cartons at the distal ends of the product lanes.

A series of selector wedges engage the lines of product moving along the product lanes so as to separate groups of one to four products, or more, for loading into a carton. The selector wedges generally will have a reduced height or profile so as to pass under the lane guides without interference therewith, and typically include a first or forward engaging surface adapted to engage a bottom portion of the selected products within the product lanes, and an angled or rearwardly tapering distal side edge adapted to facilitate movement of the selector wedges between adjacent products and reduce undue engagement with the remaining, additional products moving along the product lane as each selector wedge engages the last product of a selected group of products. The selector wedges accelerate and urge the selected groups of products along the product lanes at a rate faster than the rate of the movement of the remaining products in the product lanes. As a result, the groups of products are separated from the remaining products within the product lanes and are urged into and through the open ends of a corresponding carton.

In addition, a series of lugs are brought into engagement with each of the products being engaged by the selector wedges at or substantially about the same time that the bottom portions of the products are being engaged and accelerated by the selector wedges. The lugs typically are mounted on an overhead lug conveyor that conveys the lugs into engagement with an upper portion of each product, with the lugs moving in substantially timed relation with the movement of the selector wedges therebelow. The lugs further can be arranged slightly out of phase with the selector wedges and/or raised and lowered with respect to the products. For example, when taller, contoured products are being packaged, the lugs of the overhead conveyor can be brought into engagement with the contoured portions of the products at about substantially the same time as the base portions of the products are being engaged by the selector wedges. The lugs accordingly engage and push the upper portions of the products forwardly at approximately the same rate of movement/acceleration as the selector wedges. The engagement of the upper portions of the products by the overhead lugs thus provides additional support and stability for the upper portions of the products being engaged to prevent the products from tilting or tumbling backwards as their bottom or lower portions are engaged and accelerated forwardly by the selector wedges.

After the cartons have been loaded with the requisite number of products, as the product cartons pass the last product lane, they will move into engagement with a push-in wheel or similar loading mechanism. The push-in wheel generally is positioned at a height or level sufficient to engage and roll along the products as the cartons pass thereby. The push-in wheel thus tends to urge the last groups of products within each of the cartons forwardly, fully into their cartons to complete the loading of the products in the cartons. Thereafter, the cartons can pass through a closing station mechanism in which the upper, lower, and side end flaps of the cartons can be closed and sealed.

Various objects, features, and advantages of the present invention will become apparent to those skilled in the art upon reading the following detailed description, when taken in conjunction with the accompanying drawings.

DETAILED DESCRIPTION OF THE INVENTION

Figure 1A:
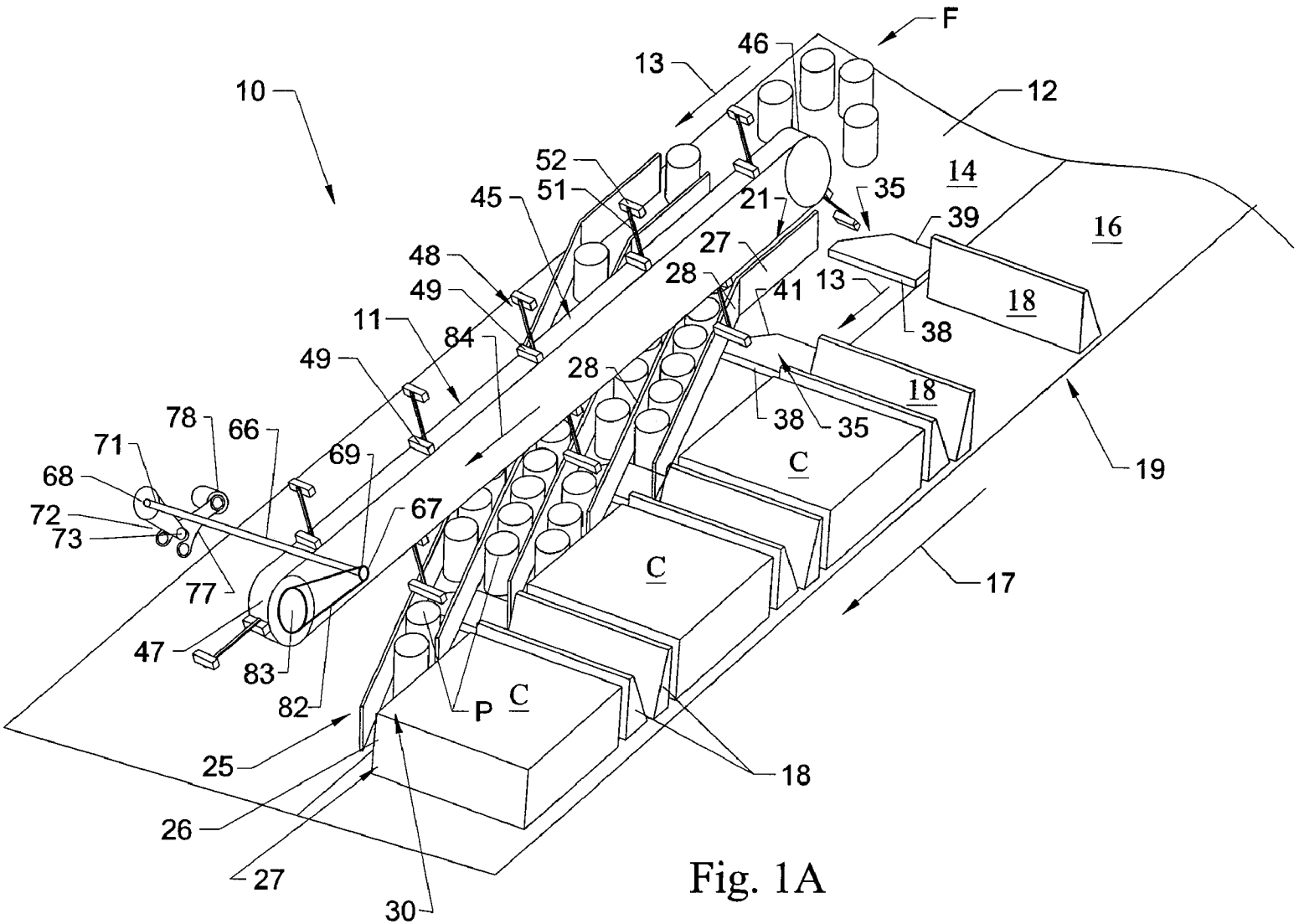
FIG. 1A is a perspective view illustrating the product packaging system with overhead lug assembly according to the present invention.

Referring now to the drawings in greater detail in which like numerals indicate like parts throughout several views, FIGS. 1A-3 generally illustrate the product packaging system 10 according to the present invention, including an overhead lug system or assembly 11 for use in packaging a series of products P in corresponding product containers or cartons C. The products P generally are illustrated herein as including cans (FIGS. 1A and 1B) or bottles (FIGS. 2 and 3) that are conveyed along a product infeed conveyor 12 in a substantially upstanding, vertically oriented attitude. It will be understood by those skilled in the art, however, that while the present invention is illustrated in use for packaging products such as cans or bottles into a series of product cartons C, various other types of products, including pouches, or other, similar products of varying sizes and configurations also can be packaged within the product cartons by use of the present invention. For example, instead of being limited to packaging substantially cylindrical cans or bottles having a tapered upper portion as shown in the drawings, it also is possible to package other types of products, with the products being substantially controlled and prevented from tipping or toppling over as they are separated into product groups and loaded into their respective product cartons. The product cartons themselves likewise can include a variety of different type or configuration of containers, including paperboard boxes or cartons, as well as containers formed from other types of materials.

Figure 1B:
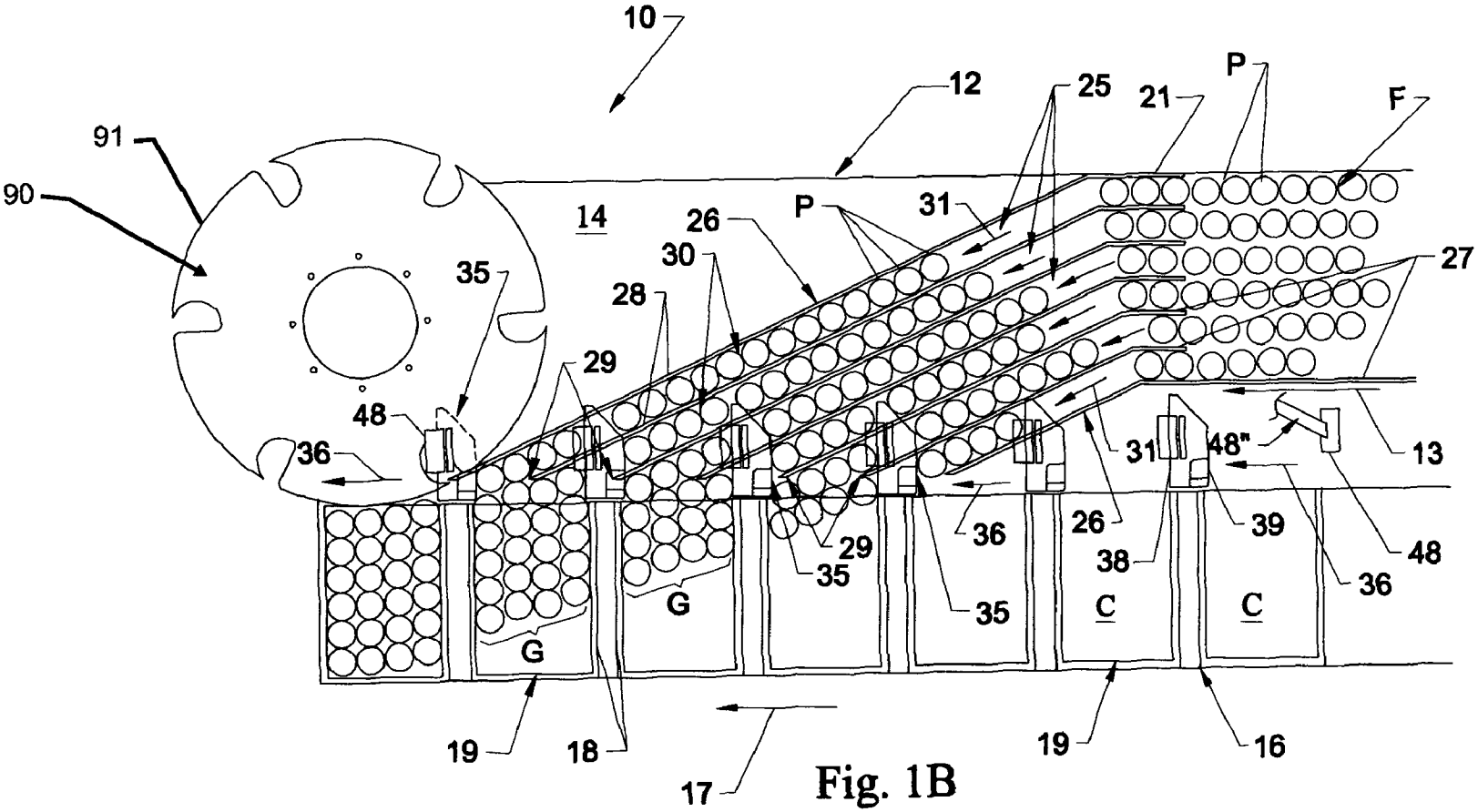
FIG. 1B is a top plan view schematically illustrating the product packaging system of the present invention.

As indicated in FIGS. 1A and 1B, a flow F of products P generally is received and conveyed along the product infeed conveyor 12 along a processing path that initially extends in the direction of arrow 13. The product infeed conveyor generally is a belted or similar type conveyor having an upper surface 14 on which the flow F of products P is conveyed, with the products generally arranged in an upstanding, substantially vertically oriented attitude. The product infeed conveyor 12 further generally extend substantially parallel to a carton conveyor 16, which conveys the cartons C along a path of travel indicated by arrow 17. As indicated in FIGS. 1A and 1B, the carton conveyor generally can include a belt, chain, or similar type conveyor and typically will include of spaced lugs or walls 18 defining flights 19 in which the product cartons C are received. The carton conveyor 16 further can be operated at a speed that is slightly greater than that of the product infeed conveyor such that the cartons are moving at a slightly faster or accelerated rate than the rate of movement of the flow F of products P being conveyed along the product infeed conveyor.

As shown in FIG. 1B, the flow F of products P is moved along an initial section of the product infeed conveyor 12, indicated by arrow 13, to an intermediate point 21 at which the products engage a series of lane guides 25 that separate the flow F of products P into discrete lines of products. For example, as illustrated in the drawings, the products P can be divided into single lines of products, with each of the products being moved substantially in single file. Each of the lane guides 25 generally is an upstanding plate or guide rail 26, typically formed from a non-stick material such as polished aluminum or other metal material, or formed from various plastic or synthetic materials. Each of the guide rails includes a first or upstream section 27 adjacent the far or distal edge of the product infeed conveyor, and an angled, second or downstream section 28 terminating at a loading position or point 29 adjacent the carton conveyor 16 as shown in FIG. 1B.

Figure 3:
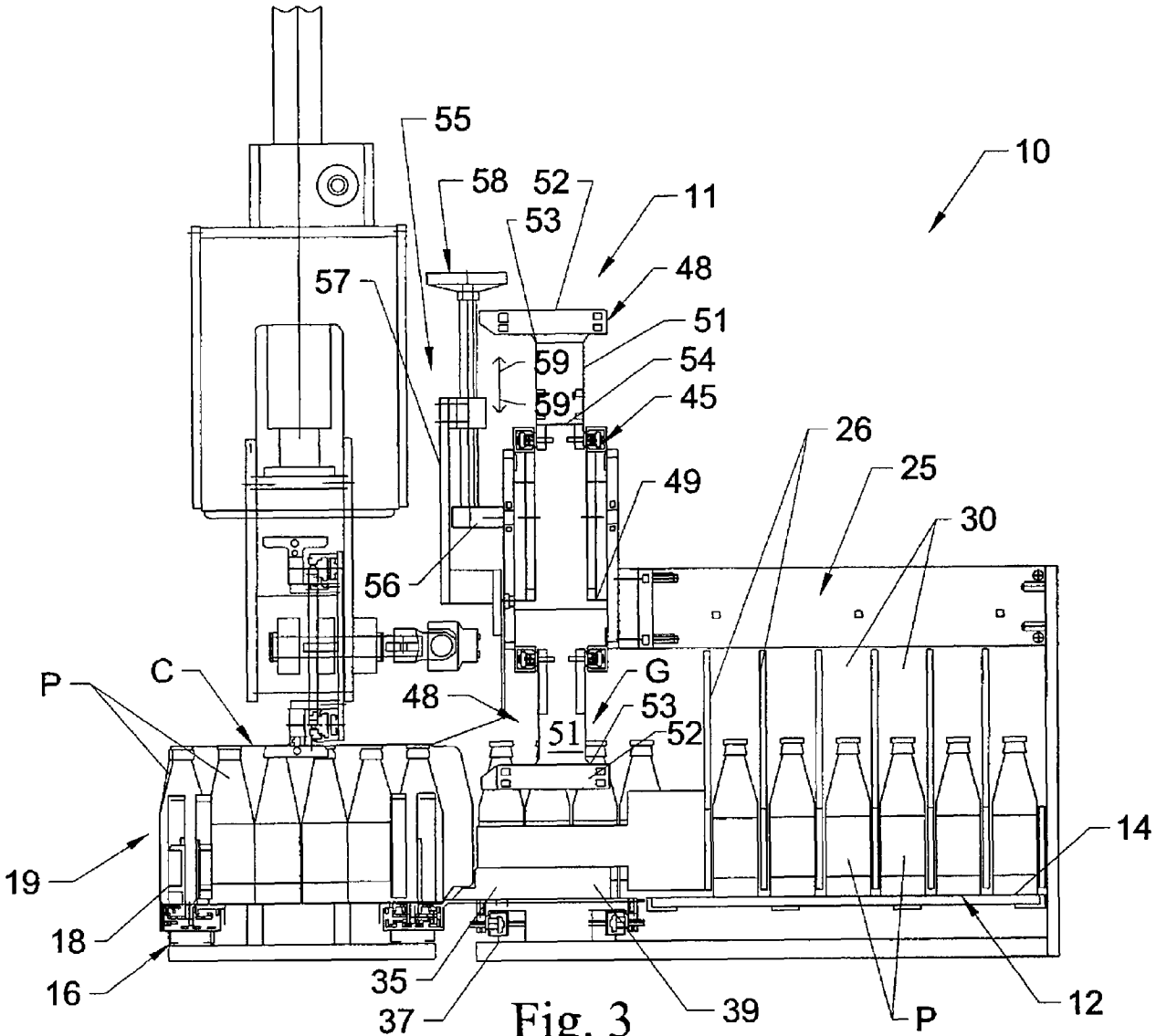
FIG. 3 is an end view illustrating the engagement and insertion of a group of products into a carton using the lugs and selector wedges of the packaging system of the present invention.

The guide rails further can be positioned so as to engage the products along a mid-portion or section of the products, with the guide rails typically being spaced above the surface of the product infeed conveyor 12. As indicated in FIGS. 1A, 1B, and 3, the downstream sections 28 of the lane guides extend at an angle with respect to the product infeed conveyor 12, extending substantially across the width of the product infeed conveyor. The lane guides further are spaced apart, typically approximately or slightly greater than the width or diameter of at least one product, or greater where the products are being conveyed in pairs or other arrangements, so as to define a series of product lanes 30. The products are received and redirected along these product lanes along a path of travel indicated by arrow 31 toward the carton conveyor and cartons C for loading therein. As the product infeed conveyor continues to urge the products forwardly in the direction of arrow 13, products will engage and slide along the guide rails, causing the products to move along the product lanes in the direction of arrow 31.

A series of selector wedges 35 (FIGS. 1A-3) are moved across the path of travel 31 of the products P along their product lanes 30, as indicated by arrows 36, into engagement with the lines of products for separating and loading groups G of the products into their respective cartons C. Each of these selector wedges 35 generally is mounted to a wedge conveyor or similar drive mechanism 37 (FIG. 3), which conveys the selector wedges along their path of travel, indicated by arrows 36, across the upper surface 14 (FIG. 1B) of the product infeed conveyor into engagement with the lines of products moving along the product lanes 30. The selector wedges 35 generally are formed from a plastic material such as Delrin, nylon, or other similar non-stick materials, and typically have a low height profile so as to be able to pass through the spacing beneath the lane guides 25. As indicated in FIG. 1B, each of the selector wedges 35 generally includes a laterally extending front face or pusher surface 38 adapted to engage and push a bottom or lower portion of each of the products P, as indicated in FIG. 3, and a rear or base portion 39 (FIG. 1B) having rearwardly slanted or tapering distal side surface 41 extending from the front face 38 to the rear surface 39. The slanted side surface 41 helps facilitate the continued forward movement of the remaining products in the product lane as a group G of products is engaged and separated from the remaining products of the line of products moving along the product lane 30 as indicated in FIGS. 1B and 2.

It will be understood that while a group G of four products P is illustrated as being separated from the remaining products moving along the product lanes in the drawings, it is possible to form product groups of varying sizes from one to four or more products. Additionally, the selector wedges 35 generally are conveyed at a rate that is faster than the rate of movement of the flow of products being conveyed along the product infeed conveyor 12. As a result, as the selector wedges engage the last product in each selected group of products, the faces 41 of the wedges tend to hold back the forward movement of the upstream products along the product lanes 30. This causes the product groups to be separated as they are away from the remaining products in the line of products being conveyed along the product lanes for loading in the product cartons.

Figure 2:
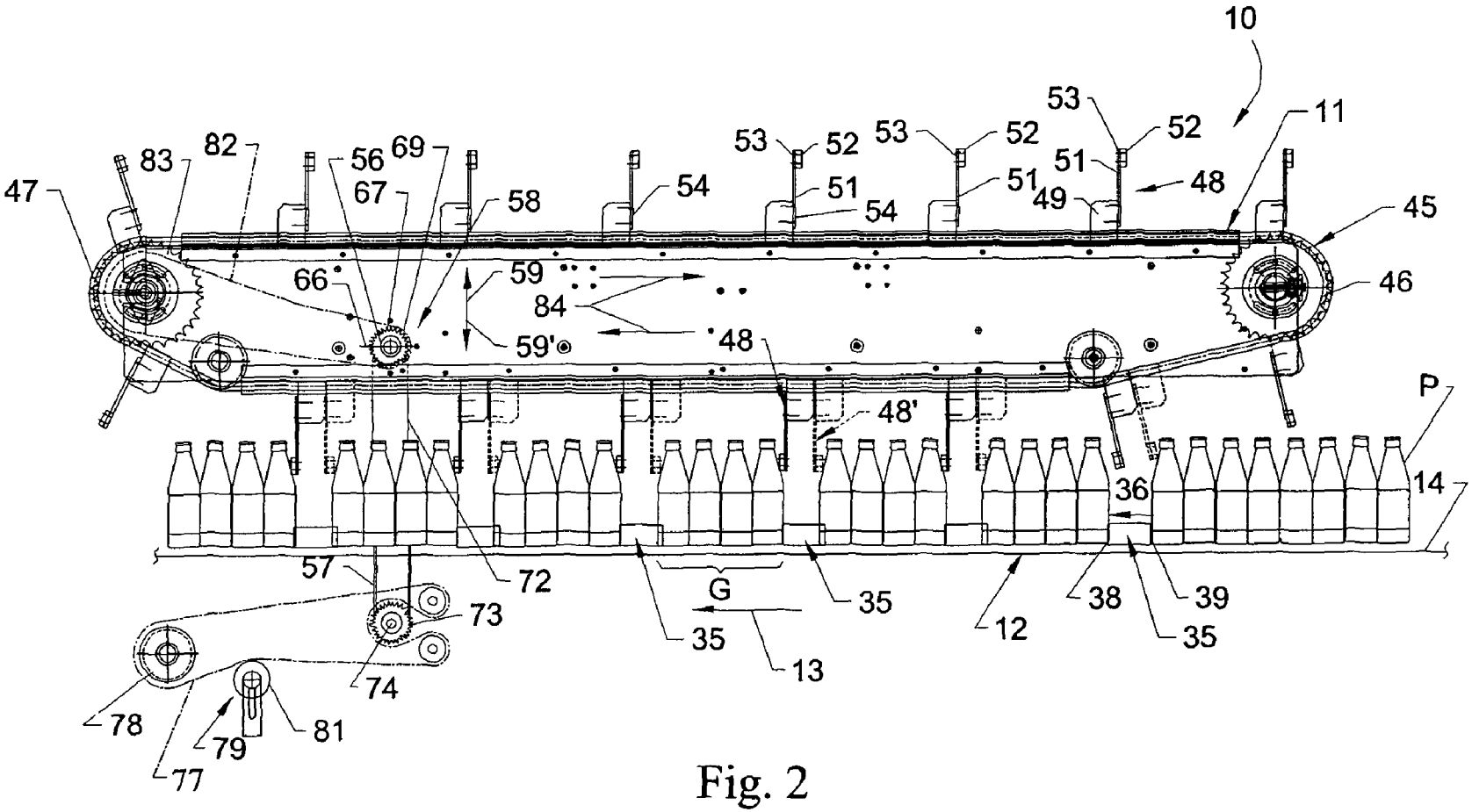
FIG. 2 is a side elevational view illustrating the operation of the selector wedges and overhead lug conveyor of the product packaging system of the present invention.

As indicated in FIGS. 1A, 2-4, the overhead lug system 11 of the present invention generally is mounted above the product infeed conveyor 12, extending substantially parallel thereto. The overhead lug system 11 generally is aligned and operated in substantially timed relation with the selector wedge conveyor 37 passing therebeneath. The overhead lug system 11 generally includes a conveyor 45, such as a chain or belt conveyor, or similar conveyor system. As shown in FIG. 2, the conveyor 45 extends from a first or upstream end 46 positioned upstream from the point at which the selector wedges 35 begin to engage the lines of products P, to a downstream or second end 47 positioned downstream from the last of the product lanes or lane guides.

Figure 4:
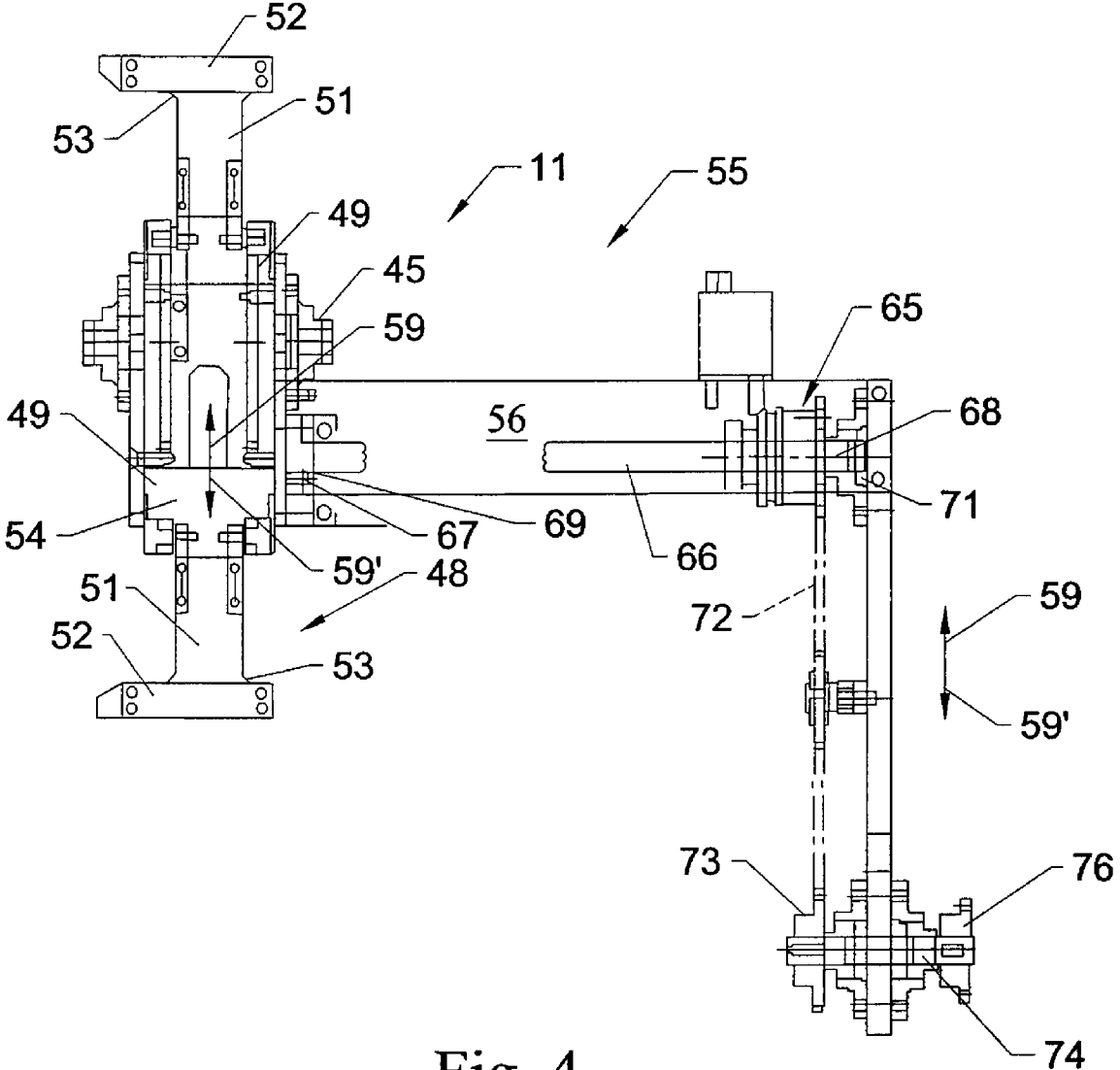
FIG. 4 is an end view schematically illustrating the drive system for the overhead lugs.

The conveyor 45 of the overhead lug system 11 further includes a series of lugs 48 mounted on holders 49 attached in spaced series about the conveyor 45. As illustrated in FIGS. 3 and 4, the lugs can include an elongated, vertically extending body portion 51 to which a pad or pusher plate 52 is attached at the distal end 53, thereof. Alternatively, the body and pusher plate 51 and 52 of each of the lugs 48 can be integrally formed together, such as by molding or stamping the lugs from a plastic or metal material. The opposite or proximal end 54 (FIG. 2) of each lug body 51 generally is attached to its holder 49, which in turn is mounted along the conveyor 45. The lugs generally will be mounted in a fixed position extending radially outwardly from their conveyor 45, although it is possible to provide for adjustment of the lugs within their holders 49 as needed to adjust the vertical position of the lugs as they engage an upper portion or neck of the products P.

As additionally illustrated in FIGS. 2 and 3, the conveyor 45 of the overhead lug system 11 typically can be mounted on a vertically adjustable support mechanism 55. The support mechanism 55 can include a horizontally extending arm 56 attached at one end to the frame of the conveyor 45, and at an opposite end to a vertically oriented, telescoping or moveable support plate or bracket 57. An adjustment mechanism 58, such as a jack-screw, etc., is connected to the support bracket 57 (FIG. 3) for causing the vertical adjustment of the support bracket 57 and thus the overhead conveyor 45 in the direction of arrows 59 and 59', so as to adjust the vertical position of the lugs 48 with respect to the products being conveyed on the product infeed conveyor therebelow. It will, however, be understood that other types of adjustment mechanisms such as a motor or pneumatic or hydraulic cylinder also can be used to control the vertical positioning of the lugs with respect to the products being conveyed therebelow, so as to ensure consistent and proper engagement with an upper portion of each of the products by the product lugs to avoid marring or scuffing the labels or any graphics thereon.

As indicated in FIG. 2, the conveyor 45 of the overhead lug system 11 is driven by a drive system 65 that generally includes a central drive shaft 66 (FIG. 4) that extends along the arm 56 of the support structure 55 for the conveyor. The drive shaft 66 has drive gears 67 and 68 mounted at the proximal or first and distal or second ends 69 and 71, respectively, thereof. A drive belt 72 engages and wraps about the drive gear 68 at the distal end 71 of the drive shaft 66 and extends vertically downwardly to a lower drive gear 73 mounted therebeneath. The lower drive gear in turn is connected via a secondary drive shaft 74 to a secondary drive gear 76 as indicated in FIG. 4. As shown in FIG. 2, a drive belt or chain 77 is encircled about and engages the secondary drive gear 76 and itself can be engaged by, or can be run off of a drive shaft 78 from the product conveyor below. Alternatively, the conveyor 45 can be directly driven via a motor mounted adjacent one of its drive sprockets 46 and 47.

A tensioning assembly 79, as indicated in FIG. 2, engages the drive belt 77 and includes a roller or gear 81 biased inwardly against the drive belt 77 to help maintain tension in the drive belt as the conveyor 45 of the overhead lug assembly 11 is adjusted vertically. The drive motor 78 drives the drive belt 77 so as to correspondingly drive the lower gear 73, which in turn drives the drive belt 72 to cause rotation of the upper drive gear 68. The rotational motion of the upper drive year 68 is translated via the central drive shaft 66 to drive gear 67, which in turn drives an additional drive chain or belt 82 that is connected to and drives the downstream drive sprocket 83 for the conveyor 45 of the overhead lug system. Typically, the conveyor 45 of the overhead lug system will be driven at a rate so as to convey the lugs 48 about their path of travel as indicated by arrows 84 in timed relation with the movement of the selector wedges passing therebeneath.

Figure 5A:
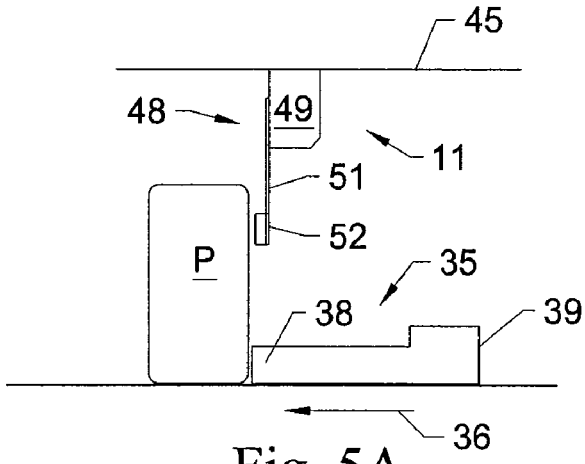
FIGS. 5A-5C are illustrations illustrating the engagement of the selector wedges and lugs with products of different sizes and configurations.

As indicated in FIG. 5A, the overhead lugs typically are driven at a rate substantially equivalent to the rate of movement of the selector wedges, with the overhead lugs being capable of being moved substantially parallel to and in time with the selector wedges. As a result, as the selector wedges engage the bottom portions of the selected products, the lugs 48 will substantially simultaneously engage the upper or top portion of the selected products. As a result, as the selector wedges accelerate the bottom portions of the products so as to separate and move a group of products away from the remaining products in each product lane, the engagement of the upper portions of the products by the overhead lugs and forward movement thereof by the lugs 48 will help reduce or prevent the rearward tipping or falling backwards of the products by stabilizing the upper portions of the products and causing them to be moved at substantially the same rate as the lower or bottom portions of the products. This provides enhanced control of the movement of the products to help ensure substantially consistent loading and reduced product tipping or jams.

Figure 5B:
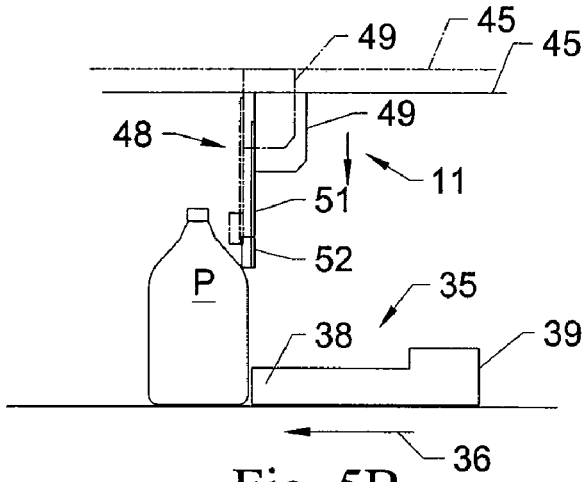
Figure 5C:
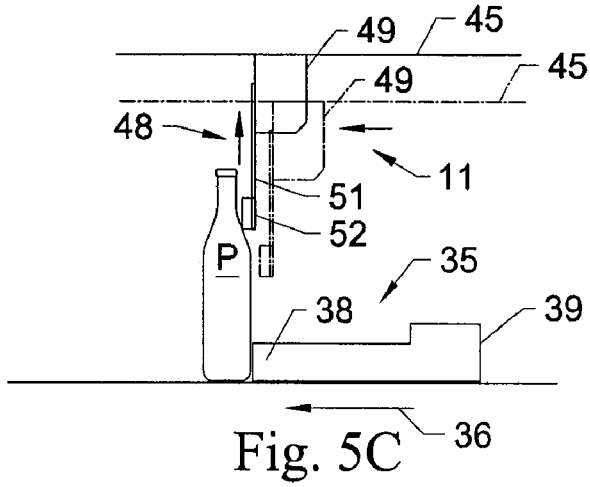

As further indicated in FIGS. 5B and 5C, the vertical position of each of the lugs can be adjusted as needed, typically through the adjustment of the conveyor 45 vertically with respect to the product infeed conveyor, so as to enable the lugs to be lowered or raised as needed into a position for engagement with the upper portion of the products without adjustment or the use of higher or larger profile selector wedges. In addition, as indicated in FIG. 5C, the lugs further can be mounted or positioned so as to be out of phase with the selector wedges. For example, the lugs can be mounted in a position that is slightly forward or in front of the selector wedges when contoured products such as long neck bottles, tapered bags or other similar products are being packaged. It is, however, also possible to adjust the position of the lugs to a point slightly behind the forward edge of the selector wedges as needed, depending upon product configurations. The adjustment of the position of the lugs with respect to the forward edge of the selector wedges helps ensure that the lugs will engage the upper portion of the products being engaged by the selector wedges at substantially or approximately the same time as the selector wedges are engaging the bottom portions of such products to ensure consistent engagement at the upper and lower portions of the products to reduce or prevent the product tipping or falling backwards.

As additionally illustrated in FIG. 2, it is further is possible to include additional product lugs mounted in an opposite facing direction along the product conveyor. Such product lugs, indicated by dashed lines 48' in FIG. 2, can be positioned and oriented facing rearwardly, so as to engage the upper portions of the foremost products in each of the product groups G being selected to prevent these foremost products from tipping forwardly as they are pushed and accelerated from behind as the selector wedges 38 and product lugs 48 engage and accelerate the movement of the rear products in each product group.

As further illustrated in FIG. 1B, a push-in wheel 90 typically can be mounted downstream from the last product lane 29. The push-in wheel can be made from plastic or synthetic materials such as Delrin, nylon, or other materials having a non-stick surface. The push-in wheel generally includes an outer edge or periphery 91 and is rotatably mounted in a position to engage and roll over the product of the last product grouping to be loaded in a product carton. As indicated in FIG. 1B, the push-in wheel generally is mounted in a position so as to project or extend across the product infeed conveyor into a position adjacent and substantially in line with the open ends of the product cartons C and moved along the carton conveyor 16. As a result, as the open ends of the cartons pass by the push-in wheel and come into engagement therewith, the push-in wheel tends to roll along and urge the products of the last group of products being loaded in the cartons inwardly to complete the loading of the carton. Thereafter, the cartons can be conveyed to a downstream closing or gluing station where the flaps of the cartons will be folded into closed positions and sealed to complete the packaging operation.

In use of the packaging system 10 of the present invention, as illustrated in FIGS. 1A and 1B, a flow F of products P will be conveyed initially in the direction of arrow 13 along a product infeed conveyor 12. The flow F of products is conveyed into engagement with a series of lane guides or guide rails 26 that separate and redirect the flow of products along a series of product lanes 29 toward corresponding cartons being conveyed along a carton conveyor 16 adjacent the product infeed conveyor. As the products are urged against the angled walls of the product lanes, they are caused to move diagonally across the product infeed conveyor toward a loading position for loading into the open end of a corresponding carton.

As the products approach the loading positions at the ends of the product lanes, a series of selector wedges are moved into engagement with selected ones of the products moving along the product lanes as indicated in FIG. 1B. The selector wedges 35 each engage a last product of a group of products and separate the group of products (for example 1-4 products) from the remaining products in the product lanes. The selector wedges accelerate the forward movement of the groups of products along the product lanes to separate the groups of products from the remaining products in the product lanes and urge the products into the open end of a corresponding product carton passing by the loading position at the end of each of the product lanes. As indicated in FIG. 2, at substantially the same time the bottom portions of each of the last products within the product group are being engaged by the selector wedges, lugs 48 are conveyed by an overhead conveyor system 45 into engagement with upper portions of each of these products. The lugs 48 tend to engage the upper portions of the products at the substantially same time that the bottom portions of the products are being engaged by the selector wedges. The lugs also typically are moved at approximately the same rate as the movement of the selector wedges so that the upper and lower portions of the products being engaged are accelerated and urged forwardly at approximately the same rate. Engagement of the products by the lugs and selector wedges at the upper and lower portions of the products helps to stabilize the products as they are accelerated forwardly and prevent or reduce the backwards tipping of the products, which can cause product jams or misfeeding of the products, or damage the products.

As indicated in FIG. 1B, the groups G of products P are progressively loaded within the cartons C being conveyed along the carton conveyor 16 as the cartons are moved in the direction of arrow 17. After the last group of products has been introduced into the open end of each carton, the cartons pass by a push-in wheel 90. The outer edge of the push-in wheel tends to engage and roll along the last group of products within the carton as the cartons pass by the push-in wheel and accordingly urges the products forwardly into the carton against the sealed rear end thereof in order to complete the loading of the products within their cartons. The cartons thereafter can be fed to a downstream closing or gluing station where the end flaps of the cartons will be folded and sealed in a closed condition to complete the packaging of the products within their product cartons.

It will be understood by those skilled in the art that while the foregoing has been described with reference to preferred embodiments and features, various modifications, variations, changes and additions can be made thereto without departing from the spirit and scope of the invention.

What is claimed is:

1. A system for packaging products in product cartons, comprising:

a carton conveyor for moving the cartons along a path of travel;

a product infeed conveyor adjacent said carton conveyor and along which a flow of products is moved;

a series of product lanes arranged along said product infeed conveyor for separating and guiding the products toward the product cartons moving along said carton conveyor;

selector wedges moveable into engagement with the products moving along said product lanes and adapted to separate and urge groups of products into the product cartons; and a series of overhead lugs positioned above and moveable along a path substantially parallel to said selector wedges, said overhead lugs arranged at a height so as to engage a portion of the products being engaged by said selector wedges to help stabilize the products as the products are fed into the product cartons.

2. The system of claim 1 and further comprising an overhead conveyor assembly positioned over and extending along said product infeed conveyor adjacent said product lanes for conveying said overhead lugs along their path of travel into and out of engagement with the products moving along said product lanes.

3. The system of claim 2 and wherein said overhead conveyor assembly is mounted on an adjustable support member to enable vertical adjustment of said overhead lugs with respect to the products engaged thereby.

4. The system of claim 1 and wherein said product lanes comprise a series of spaced guides defining said product lanes therebetween.

5. The system of claim 1 and further comprising a push-in wheel mounted downstream from said product lanes for urging the products fully into the product cartons.

6. The system of claim 1 and wherein said selector wedges are mounted on and carried into engagement with the products moving along said product lanes by a wedge conveyor.

7. The system of claim 1 and wherein said selector wedges are of a height profile sufficient to enable said selector wedges to pass beneath said product lanes and engage a bottom portion of one of the products therein.

8. A method of packaging articles in a series of cartons moving along a packaging line, comprising:

moving a flow of products along an infeed conveyor along a path substantially parallel to the cartons;

redirecting and guiding the products along at least one product lane toward the cartons;

engaging and separating at least one of the products moving along the product lane at a lower portion thereof with a selector wedge;

at substantially the same time, engaging an upper portion of the at least one product being engaged by the selector wedge with a lug moving in timed relation with the selector wedge; and urging the at least one product along its product lane and into a carton with the selector wedge and lug.

9. The method of claim 8 and further comprising moving the lug forwardly of the selector wedge and out of phase therewith when the at least one product has a tapered upper portion engaged by the lug.

10. The method of claim 8 and further comprising adjusting the height of the lug as needed to engage products of varying sizes with the lug.

11. The method of claim 8 and further comprising passing the cartons with products therein adjacent a push-in wheel and urging the products fully into the cartons.

12. The method of claim 8 and wherein engaging and separating at least one of the product with a selector wedge comprises moving the selector wedge into a line of products moving toward the cartons and delaying movement of remaining products in the line of products while a selected group of products continues forwardly for introduction into a carton.

13. The method of claim 8 and wherein redirecting and guiding the products along at least one product lane comprises separating and moving lines of products from the flow of products along the product lane positioned along the infeed conveyor.

* * * * *